US010753369B2

(12) United States Patent
Hall et al.

(10) Patent No.: US 10,753,369 B2
(45) Date of Patent: Aug. 25, 2020

(54) VARIABLE DIFFUSER HAVING A RESPECTIVE PENNY FOR EACH VANE

(71) Applicants: Rolls-Royce Corporation, Indianapolis, IN (US); Rolls-Royce plc, London (GB)

(72) Inventors: Christopher Hall, Indianapolis, IN (US); Glenn Knight, Derbyshire (GB)

(73) Assignees: Rolls-Royce Corporation, Indianapolis, IN (US); Rolls-Royce plc, London ( * ) Notice: Subject to any disclaimer, the term of this patent is extended or adjusted under 35 U.S.C. 154(b) by 286 days.

(21) Appl. No.: 15/977,465

(22) Filed: May 11, 2018

(65) Prior Publication Data

US 2019/0345839 A1 Nov. 14, 2019

(51) Int. Cl.
*F04D 29/44* (2006.01)
*F04D 29/46* (2006.01)

(52) U.S. Cl.
CPC ..... *F04D 29/444* (2013.01); *F04D 29/462* (2013.01); *F05D 2240/12* (2013.01); *F05D 2250/411* (2013.01); *F05D 2260/50* (2013.01); *F05D 2260/72* (2013.01)

(58) Field of Classification Search
CPC ..... F01D 17/143; F04D 29/444; F04D 29/46; F04D 29/462; F05D 2240/12; F05D 2250/411; F05D 2260/72
See application file for complete search history.

(56) References Cited

U.S. PATENT DOCUMENTS 3,799,694 A 3/1974 Duzan
3,992,128 A 11/1976 Lunsford et al.
4,737,071 A 4/1988 Horn, Jr.
5,207,559 A 5/1993 Clevenger et al.
6,547,520 B2 * 4/2003 Zinsmeyer ..... F04D 27/0246 415/150
8,147,186 B2 4/2012 Ibaraki et al.
2005/0123397 A1 6/2005 McArdle
2009/0302152 A1 12/2009 Knight
2010/0080694 A1 4/2010 Chapman
2016/0341215 A1 11/2016 Knight et al.
2017/0233080 A1 8/2017 Knight et al.

FOREIGN PATENT DOCUMENTS

EP 0058533 B1 7/1985
EP 2626573 A1 8/2013
WO 02/095237 11/2002

OTHER PUBLICATIONS

European Search Report, dated Oct. 23, 2019, in EP Application No. 19168565.0.

* cited by examiner

*Primary Examiner* — Richard A Edgar
(74) *Attorney, Agent, or Firm* — Barnes & Thornburg LLP

(57) ABSTRACT

A variable diffuser comprises a passage, at least two vanes disposed within the passage, and at least two pennies. The passage is defined between opposing disk faces of a hub and a tip. Each of the vanes comprises a body having a leading edge and a trailing edge. The body extends between the hub face and the disk face. Each of the pennies is coupled to a respective vane body near an edge of the penny and an actuator. Rotation of at least one penny changes the orientation of the respective vane relative to the hub face.

20 Claims, 10 Drawing Sheets

VARIABLE DIFFUSER HAVING A RESPECTIVE PENNY FOR EACH VANE

BACKGROUND

Centrifugal compressors are commonly used for fluid compression in rotating machines such as, for example, a gas turbine engine. Gas turbine engines typically include at least a compressor section, a combustor section, and a turbine section. In general, during operation, air is pressurized in the compressor section then mixed with fuel and burned in the combustor section to generate hot combustion gases. The hot combustion gases flow through the turbine section, which extracts energy from the hot combustion gases to power the compressor section, other gas turbine engine loads, and to provide excess energy for either shaft power or thrust.

A centrifugal compressor is a device in which a rotating impeller delivers air at relatively high velocity through centrifugal force on the gas within the impeller. Such a compressor also includes a diffuser, which normally is an annular space surrounding the periphery of the impeller and which usually is provided with vanes to guide the gas flow in order to recover static pressure, and minimize turbulence and frictional losses in the diffuser. The air or other gas (which will be referred to hereafter as air) is delivered from the impeller with a substantial radial component of velocity and ordinarily a substantially greater tangential component. The function of the diffuser is to decelerate the air smoothly and to recover as static pressure (head) the total or stagnation pressure (dynamic head) of the air due to its velocity.

While centrifugal compressors operate over a variety of flow conditions and ranges, they are designed to operate most efficiently at one set of operating conditions, usually referred to as the design point. For example, a centrifugal compressor may be designed for maximum efficiency and minimum adequate surge margin when operating to supply maximum shaft horsepower. As a consequence of selecting these design conditions, when the compressor is operating off the design point, it operates at reduced efficiency and potentially reduced stall margin. It is therefore desirable to improve the compressor's efficiency and low flow stall margin when operating off the design point. One option for improving efficiency and/or stall margin can be to vary the diffuser area as the operating point of the compressor changes.

SUMMARY

According to some aspects of the present disclosure, a variable diffuser comprises a passage defined between opposing faces of a hub and a tip, at least two vanes within the passage, and at least two rotatable pennies. Each of the vanes comprises a body having a leading edge and a trailing edge, and the body extends between the hub face and the tip face. Each of the pennies is coupled to a respective vane body and an actuator. Each penny is coupled to a respective vane body near an edge of the penny. Rotation of at least one penny changes an orientation of the respective vane relative to the hub face.

In some embodiments each penny is rotatable a minimum of 90 degrees. In some embodiments each vane body defines a slot and each penny is coupled to a respective body via a pin extending from the penny and into the respective slot. In some embodiments each penny comprises a forked pin extending from a face of the penny, and each penny is coupled to a respective body such that the body is disposed within a fork of the forked pin. In some embodiments each penny defines a recess configured to receive a respective pin, and each body is coupled to the respective penny by a respective pin extending from the body into the recess. In some embodiments the hub face defines a slot respective to each body and each body is further coupled to the hub face via a pin extending from the body into the respective slot. In some embodiments the recess is elongated allowing the respective pin to translate.

In some embodiments each penny is configured to rotate in unison with the other pennies. In some embodiments the actuator comprises an actuating ring, each penny has a drive shaft extending from a first face of the penny, and the actuating ring is coupled to each penny drive shaft via a respective coupling member. The first face is opposite a second face of the penny proximate the respective vane body. In some embodiments the coupling member is a pinion gear. In some embodiments the coupling member is an arm linkage.

In some embodiments the orientation of each vane body is continuously variable between a first position and a second position. In some embodiments the first position results in a passage that is more open than the second position. In some embodiments each penny is housed in the hub face. In some embodiments each vane body is coupled to the tip face via a freewheeling penny.

According to further aspects of the present disclosure, a centrifugal compressor comprises an impeller having a high pressure outlet; a scroll; and a variable diffuser between the impeller and the scroll. High pressure gas flows from the high pressure outlet through the variable diffuser to the scroll. The variable diffuser comprises a passage defined between opposing faces of a hub and a tip, at least two vanes within the passage, and at least two rotatable pennies. Each of the vanes comprises a body having a leading edge and a trailing edge, and the body extends between the hub face and the tip face. Each of the pennies is coupled to a respective vane body and an actuator. Each penny is coupled to a respective vane body near an edge of the penny. Rotation of at least one penny changes an orientation of the respective vane relative to the hub face.

In some embodiments each penny is configured to rotate in unison with the other pennies. In some embodiments the actuator comprises an actuating ring, with each penny having a drive shaft extending from a first face of the penny, and the actuating ring is coupled to each penny drive shaft via a respective coupling member. The first face is opposite a second face of the penny proximate the respective vane body. In some embodiments the coupling member is a pinion gear. In some embodiments the coupling member is an arm linkage.

In some embodiments the orientation of each vane body is continuously variable between a first position and a second position. In some embodiments the first position results in a passage that is more open than the second position. In some embodiments each penny is housed in the hub face. In some embodiments each vane body is coupled to the tip face via a freewheeling penny.

According to further aspects of the present disclosure, a method is presented of varying fluid flow exiting a centrifugal compressor. The method comprises defining a diffuser passage between a pair of axially displaced and opposing disk faces; fixing a plurality of vanes in the diffuser passage, each vane extending between the opposing disk faces and coupled to a respective penny housed in a first of the disk faces; and transitioning each of the plurality of vanes from a first orientation relative to the diffuser passage to a second orientation relative to the diffuser passage by rotating each respective penny in unison.

In some embodiments each respective penny is coupled to an actuator and the step of transitioning each of the plurality of vanes from a first orientation relative to the diffuser passage to a second orientation relative to the diffuser passage by rotating each respective penny in unison is performed by actuating the actuator. In some embodiments each respective penny is rotatable through a minimum of 90 degrees of rotation.

According to further aspects of the present disclosure, a variable diffuser comprises a passage defined between opposing faces of a hub and a tip, at least one vane within the passage, and at least one rotatable penny. The vane comprises a body having a leading edge and a trailing edge, and the body extends between the hub face and the tip face. The at least one rotatable penny is coupled to the body and an actuator. The penny is coupled to the body near an edge of the penny. The hub face defines a slot and the body is coupled to the hub face via a pin extending from the body and into the slot, the pin movable within the slot. Rotation of at least one penny changes an orientation of the at least one vane relative to the hub face.

In some embodiments the slot can be oriented radially with respect to a center axis. In some embodiments the slot can be oriented circumferentially with respect to a center axis. In some embodiments the tip face defines a second slot opposite the slot in the hub face, and the body is coupled to the tip face via a second pin extending from the body to the second slot.

In some embodiments the penny is configured to rotate in unison with other pennies. In some embodiments the actuator comprises an actuating ring, and the penny has a drive shaft extending from a first face of the penny, and the actuating ring is coupled to each penny drive shaft via a respective coupling member. The first face opposite a second face of the penny proximate the respective vane body. In some embodiments the coupling member is a pinion gear. In some embodiments the coupling member is an arm linkage.

In some embodiments the orientation of the vane is continuously variable between a first position and a second position. In some embodiments the first position results in a passage that is more open than the second position. In some embodiments the penny is housed in the hub face. In some embodiments the vane body is coupled to the second disk via a freewheeling penny.

According to further aspects of the present disclosure, a variable diffuser comprises a passage defined between opposing faces of a hub and a tip, a vane within the passage, and a rotatable penny. The vane comprises a leading edge segment and a trailing edge segment. Each segment extends between the hub face and the tip face. The rotatable penny is coupled to the leading edge segment and an actuator. The penny is coupled to the leading edge segment near an edge of the penny. The hub face defines a slot and the leading edge segment is coupled to the hub face via a pin extending from the leading edge segment into the slot, the pin movable within the slot. The trailing edge segment is coupled to the hub face via a pin extending from the trailing edge segment to the hub face. Rotation of the penny changes an orientation of the leading edge segment relative to the hub face, and changes in the orientation of the leading edge segment causes changes an orientation of the trailing edge segment relative to the hub face.

In some embodiments the leading edge segment is coupled to the penny near an aft end. In some embodiments a forward end of the trailing edge segment rests on an aft end of the leading edge segment. In some embodiments the slot can be oriented radially with respect to a center axis. In some embodiments the slot can be oriented circumferentially with respect to a center axis. In some embodiments the tip defines a second slot opposite the slot in the hub, and the body is coupled to the tip via a second pin extending from the body to the second slot.

According to further aspects of the present disclosure, a method of varying fluid flow exiting a centrifugal compressor is presented. The method comprises: defining a diffuser passage between a pair of axially displaced and opposing disk faces; defining a plurality of slots within the first disk face; fixing a plurality of vanes in the diffuser passage, each vane extending between the opposing disk faces, coupled to a respective penny housed in a first of the disk faces and coupled to a respective pin extending from the vane into the respective slot; and transitioning each of the plurality of vanes from a first orientation relative to the diffuser passage to a second orientation relative to the diffuser passage by rotating each respective penny in unison and allowing each respective pin to translate within each respective slot.

In some embodiments each respective penny is coupled to an actuator and the step of transitioning each of the plurality of vanes from a first orientation relative to the diffuser passage to a second orientation relative to the diffuser passage by rotating each respective penny in unison is performed by actuating the actuator. In some embodiments each respective penny is rotatable through a minimum of 90 degrees of rotation. In some embodiments each respective vane comprises a leading edge segment coupled to an trailing edge segment, wherein the step of transitioning each of the plurality of vanes from a first orientation relative to the diffuser passage to a second orientation relative to the diffuser passage by rotating each respective penny in unison transitions each respective trailing edge segment from a first orientation relative to the leading edge segment to a second orientation relative to the leading edge segment.

BRIEF DESCRIPTION OF THE DRAWINGS

The following will be apparent from elements of the figures, which are provided for illustrative purposes.

Figure 2A:
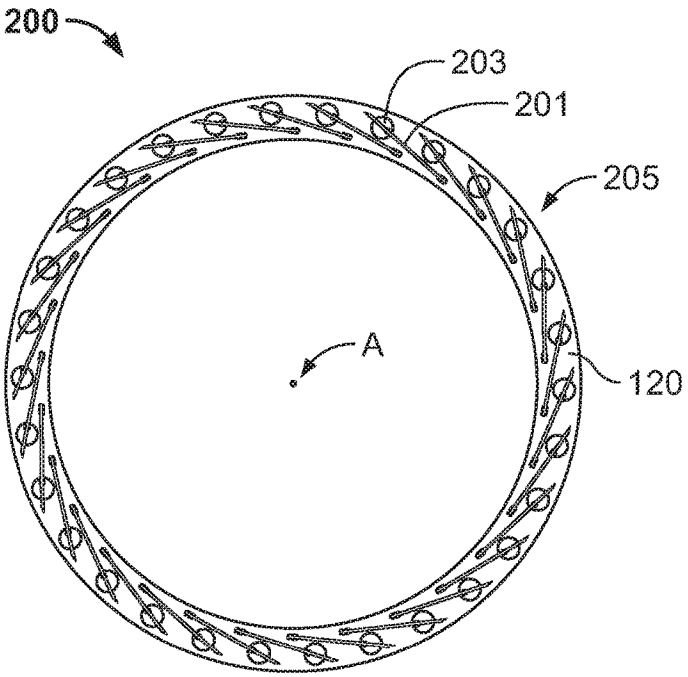
FIG. 2A is a profile view of a portion of a variable diffuser in accordance with some embodiments of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments in the drawings and specific language will be used to describe the same.

Figure 1:
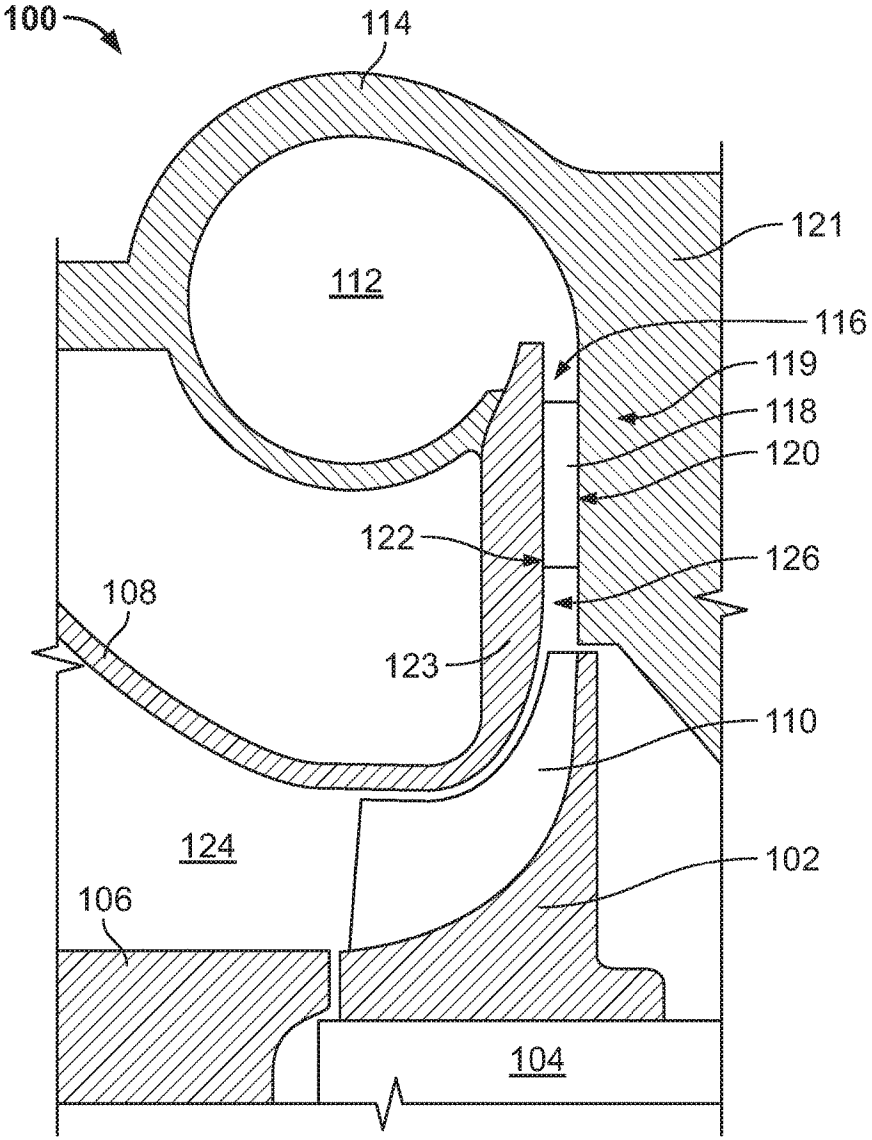
FIG. 1 is a cutaway view of a portion of a centrifugal compressor.

A typical centrifugal compressor 100 is presented in FIG. 1. The centrifugal compressor 100 comprises an impeller 102 coupled to a rotatable shaft 104, and inner casing 106, and an outer casing 108. During operation with the shaft 104 rotating, gas entering the compressor 100 via an inlet 124 is accelerated by a plurality of impeller blades 110 of the impeller 102. The inlet 124 is defined between the inner casing 106 and outer casing 108. The gas exits the impeller region at outlet 126 at a higher stagnation (total) pressure than it entered inlet 124, and passes through a diffuser 119.

Diffuser 119 comprises a hub surface 120, a tip surface 122, and a plurality of vanes 118 extending between the hub surface 120 and tip surface 122. As illustrated, hub surface 120 and tip surface 122 may be opposing faces, and may be referred to as hub face and tip face. Alternatively, hub surface 120 and tip surface 122 may be referred to as first disk face and second disk face. Vanes 118 may be fixed or variable. The hub surface 120 of hub 121 and tip surface 122 of tip 123 define a passage 116. In some embodiments, the passage extends from the outlet 126 to a swirl chamber 112 defined by the volute casing 114. Swirl chamber 112 may be a scroll. High pressure gas exiting the impeller region at outlet 126 will flow though diffuser 119 to swirl chamber 112.

As discussed above, a typical centrifugal compressor will have low stall margins during low flow conditions. Variable diffusers may be used to increase stall margins for low flow conditions. A typical variable diffuser comprises a plurality of cantilevered variable vanes extending into a passage at the outlet of the centrifugal compressor. The cantilevered vanes are coupled to a unison ring that pivots the vanes through a small angular range, typically less than 10°, although not so limited. Unfortunately, the use of a typical unison ring and cantilevered variable vanes does not afford the type of precise and accurate angular placement of the vane required to substantially improve stall margin during low flow conditions. It is therefore desirable to improve the accuracy of angular disposition of a variable vane, allowing an operator to finely tune the operation of a centrifugal compressor to improve margin to stall during low flow conditions.

Figure 2B:
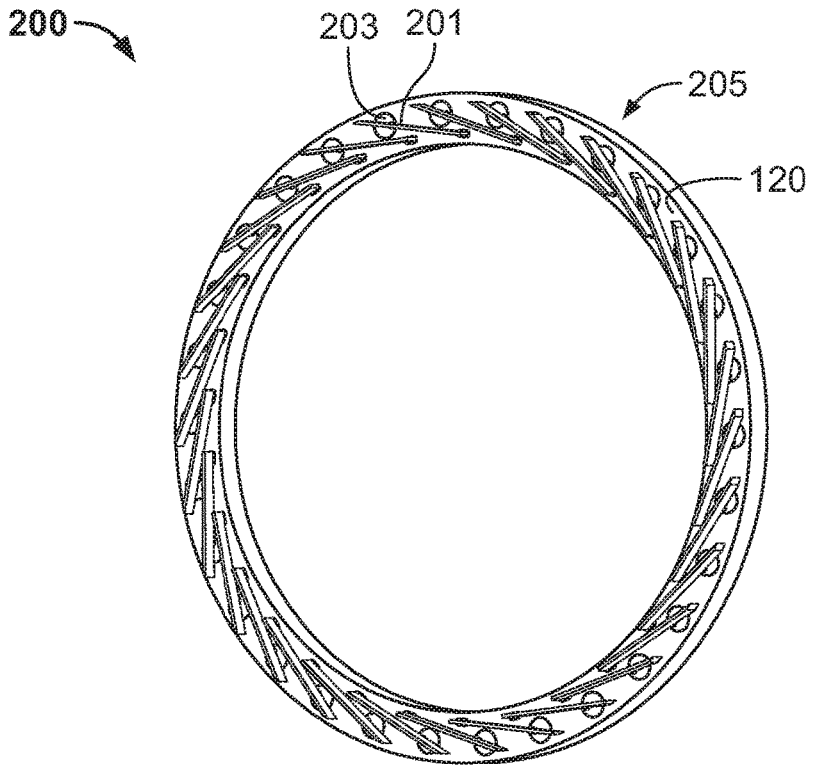
FIG. 2B is an isometric view of a portion of a variable diffuser in accordance with some embodiments of the present disclosure.
Figure 3:
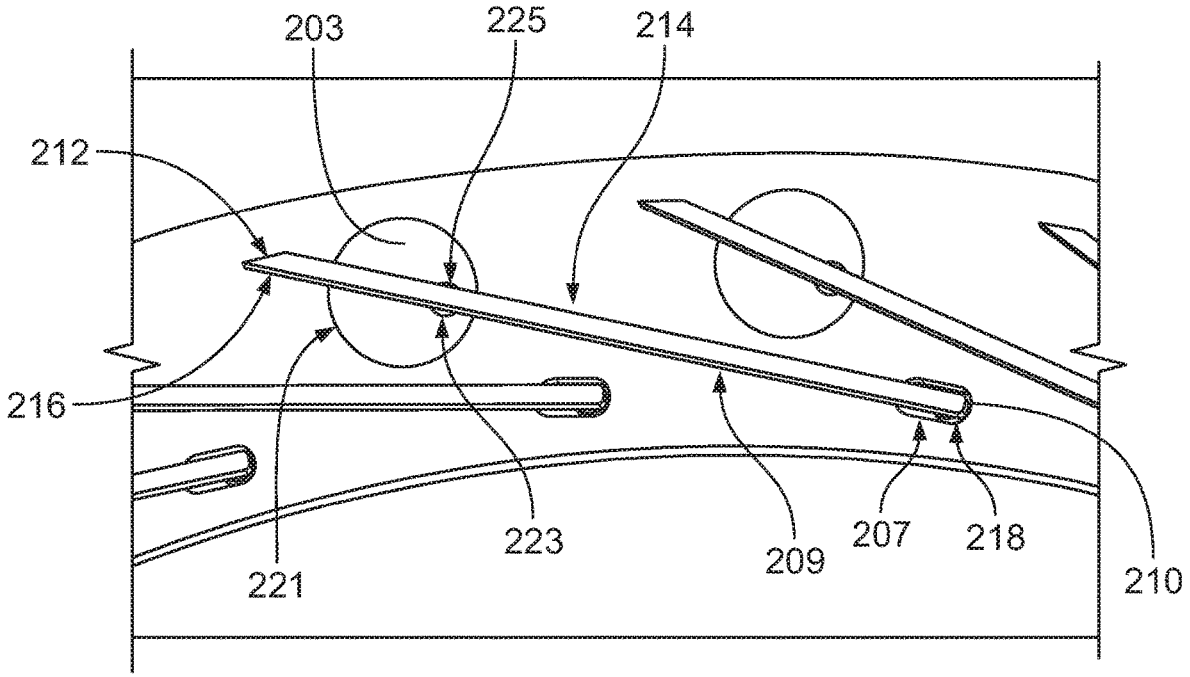
FIG. 3 is a detailed profile view of a portion of a variable diffuser in accordance with some embodiments of the present disclosure.
Figure 4:
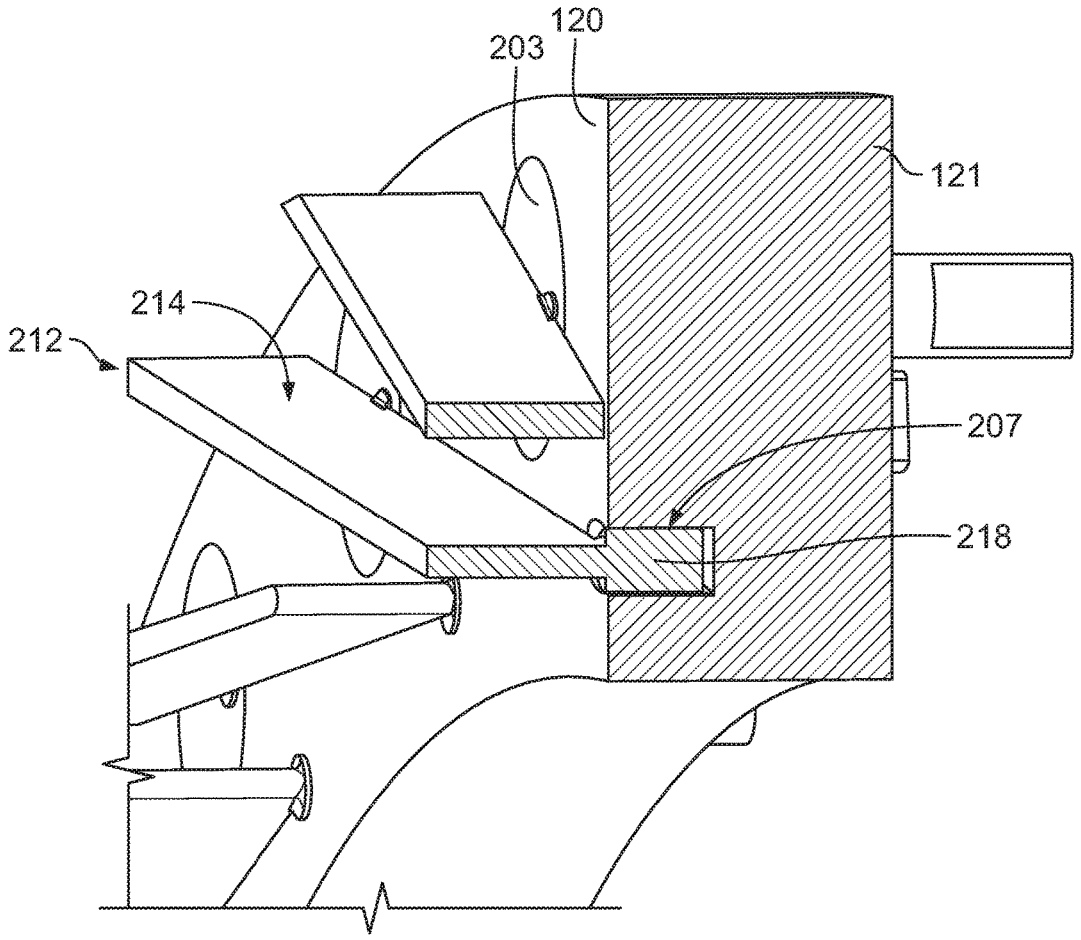
FIG. 4 is an isometric and cutaway view of a portion of a variable diffuser in accordance with some embodiments of the present disclosure.

With this basic description of a centrifugal compressor 100 in mind, attention is now given to the specific embodiments of the present disclosure. FIGS. 2A and 2B provide profile and isometric views, respectively, of a portion of a variable diffuser 200 in accordance with some embodiments of the present disclosure. FIG. 3 provides a detailed profile view of the same portion of a variable diffuser 200 in accordance with some embodiments of the present disclosure. FIG. 4 provides an isometric and cutaway view of the same portion of a variable diffuser 200 in accordance with some embodiments of the present disclosure.

The variable diffuser 200 comprises a plurality of variable vanes 201 and a plurality of rotatable pennies 203, with each of the plurality of variable vanes 201 coupled to a respective one of the plurality of pennies 203. The plurality of vanes 201 may be disposed in a passage 116 defined between a hub surface 120 and a tip surface 122. As illustrated, hub 121 has a central axis A. The central axis A may be the same as the axis of rotation of the centrifugal compressor, or may be offset from the axis of rotation.

Each of the variable vanes comprises a body 209 having a leading edge 210 disposed closest to the outlet 126 of the centrifugal compressor impeller 102 and a trailing edge 212 disposed furthest from the outlet 126 of the centrifugal compressor impeller 102. A high pressure surface 216 extends between the leading edge 210 and trailing edge 212 and substantially faces the outlet 126, while a low pressure surface 214 extends between the leading edge 210 and trailing edge 212 opposite the high pressure surface 216.

In the embodiment of FIGS. 2A, 2B, 3, and 4 each variable vane 201 may be coupled to the hub surface 120 in two locations. First, a slot 207 is defined in the hub surface 120, and a first pin 218 proximate the leading edge 210 extends from the vane body 209 into the slot 207. First pin 218 is moveable within slot 207. Slot 207 may be oriented radially, circumferentially, or at an angle relative to a central axis of hub 121 or an axis of rotation of the centrifugal compressor.

Second, a drive penny 203 is disposed in or housed by an aperture 221 in the hub surface 120, and the vane 201 is coupled to the penny 203 via a second pin 223 extending from vane body 209 and disposed in a recess 225. The penny 203 is rotatable within aperture 221. The recess 225 may be located proximate an edge of the penny 203. The aperture 221 may be located partially or entirely radially outward from a radial midpoint in the hub surface 120. In some embodiments recess 225 may be elongated, allowing second pin 223 to translate within the recess 225.

The drive penny 203 may be positioned relative to the vane 201 at an outer chord location. The penny 203 may be positioned relative to the vane 201 on the trailing edge 212 side of a midpoint between the trailing edge 212 and leading edge 210.

Vane 201 may be coupled to tip 123. For example, tip 123 may define a slot, and the slot may be opposite slot 207. Vane 201 may comprise a pin extending from the vane 201 and disposed in the slot of the tip 123 to thereby couple vane 201 to tip 123. Additional details of embodiments that couple a vane between both hub 121 and tip 123 are provided below with reference to FIG. 11.

Figure 9:
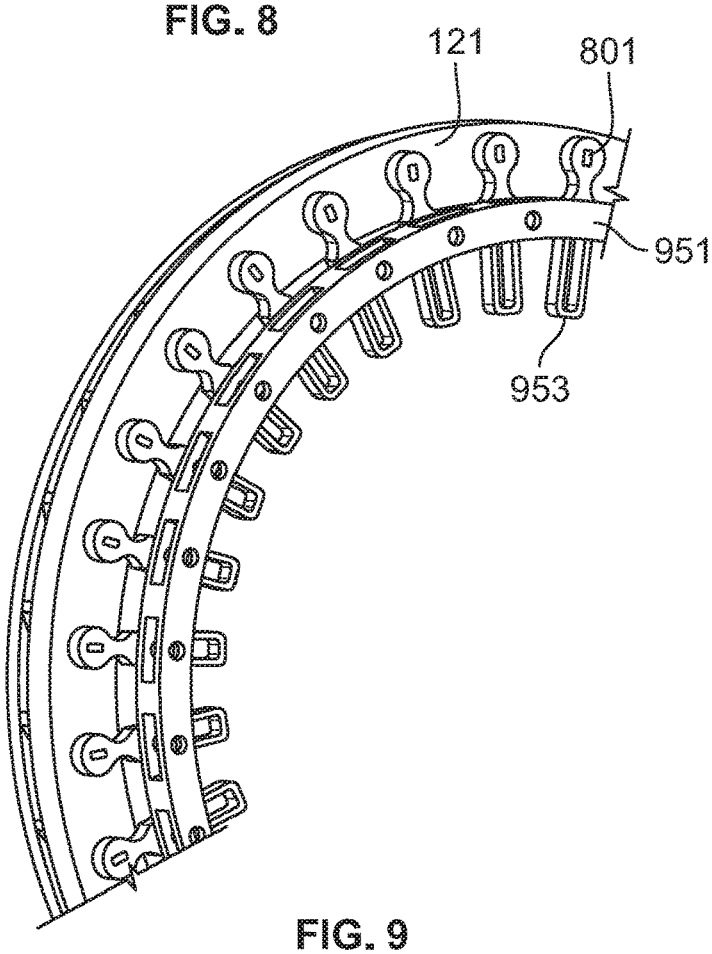
FIG. 9 is an isometric view of an actuating ring having arm linkages to each vane assembly of a variable diffuser in accordance with some embodiments of the present disclosure.

As described with reference to later FIGS. 9 and 10, drive penny 203 may be coupled to an actuator such as an actuating ring or actuating gear via a drive shaft. The actuator may actuate each of the plurality of pennies 203 in unison or substantially in unison. The actuator may be configured to rotate each of the plurality of pennies 203. In some embodiments, each penny 203 is configured to rotate at least 90°.

It will be appreciated from FIGS. 2A, 2B, 3, and 4 that rotation of a drive penny 203 causes the rotation, by pivoting action about the pin 218, of a respective vane 201 as well as translation of the vane 201 as the pin 218 moves laterally within slot 207. The rotation of the vane 201 changes the orientation of the vane 201 relative to hub surface 120 and/or relative to the direction of bulk fluid flow exiting from the centrifugal compressor 100 at outlet 126. In some embodiments the penny 203 is rotated about an axis defined by a drive shaft 801, described below. Each vane 201 may be continuously variable between a first position and a second position, with the first position providing an orientation of the vane 201 that results in passage 116 being more open than when the vane 201 is in the second position.

In some embodiments, one or more of the plurality of vanes 201 may be coupled to tip surface 122. A vane 201 may be coupled to the tip surface 122, for example, via a dummy penny that is housed in the tip surface 122 and rotates freely such that control of the orientation of a vane 201 remains with the position of penny 203. A freely rotating dummy penny may be referred to as a freewheeling penny.

The embodiment of FIGS. 2A, 2B, 3, and 4 has numerous advantages over existing variable diffusers. When designing the variable diffuser 200 of this embodiment, parameters such as the locations and sizes of slot 207, aperture 221 and drive penny 203, and recess 225, as well as the angle of the slot 207, may be varied to achieve a desired centrifugal compressor performance. By providing a unique penny 203 for each vane 201, the angular control and accuracy are greatly improved. In some embodiments, a larger rotation of the penny 203 causes a smaller rotation of vane 201 about pin 218 in order to provide high resolution control and accuracy of said vane angle. By one non-limiting example, in some embodiments rotating penny 203 by approximately 90° will cause a rotation of the vane 201 of approximately 10°.

In contrast to cantilevered vanes of the prior art, the vanes 201 of variable diffuser 200 have two points of interface with hub surface 120 (pin 218 with slot 207, and pin 223 with recess 225) instead of one, which provide greater structural stability, lowered vane stresses, and greater accuracy in vane alignment.

Figure 5:
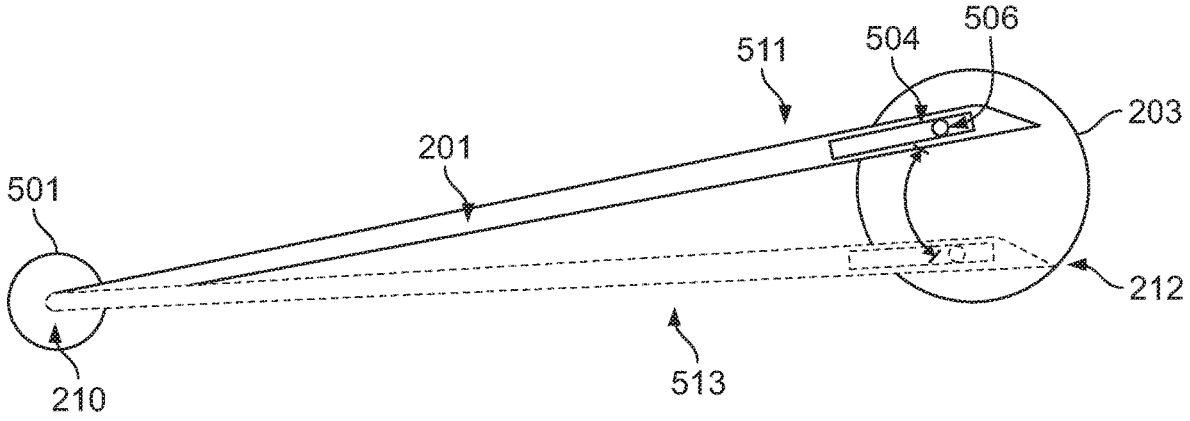
FIG. 5 is a schematic view of a vane assembly of a variable diffuser in accordance with some embodiments of the present disclosure.

In some embodiments, the vane 201 may be coupled to the penny 203 via a slotted-vane-and-pin architecture such as that shown in FIG. 5. Vane 201 may define a vane slot 504 proximate the trailing edge 212 configured to receive a penny pin 506. The penny pin 506 may extend substantially perpendicular from the disk face of the penny 203 and be at least partially disposed in vane slot 504. The penny pin 506 may be disposed near an edge of the penny 203. Vane slot 504 may be disposed on the trailing edge 212 side of a midpoint between the trailing edge 212 and leading edge 210.

At the leading edge 210 the vane 201 may be coupled to hub surface 120 by a vertex penny 501 that rotates along with the rotation of the vane 201. Vertex penny 501 may be a pin extending from the vane 201 into a corresponding recess in the hub surface 120 to allow the vane 201 to pivot.

The rotation of vane 201 is driven by the rotation of penny 203, with rotation of the penny 203 translating into motion of the vane 201 via the vane slot 504 and penny pin 506 coupling. Rotation of penny 203 may cause the penny pin 506 to slide within the vane slot 504 to be closer or further from trailing edge 212, and will cause a pivoting motion of vane 201. The vane 201 may be continuously variable between a first, more open position 511 and a second, more closed position 513 (shown in dashed lines in FIG. 5).

In some embodiments, the vane slot 504 may be disposed proximate the leading edge 210 and the vertex penny 501 may be coupled to the vane 201 at the trailing edge 212.

To accommodate the slot-and-pin design, the vane 201 of the embodiment shown in FIG. 5 may need to be relatively thicker than the vanes shown in other embodiments of this disclosure. However, there are numerous advantages associated with the slot-and-pin design, namely the improved accuracy with which the vane may be positioned and oriented due to the use of a respective penny for each vane. As in the embodiments discussed above, each vane may rotate by only a small amount for larger rotation of the drive penny, for example the vane may rotated approximately 10° for a rotation of the penny of 90°. Each vane also has two points of interface with first disk face providing greater structural stability, lowered vane stresses, and greater accuracy in vane alignment.

Figure 6A:
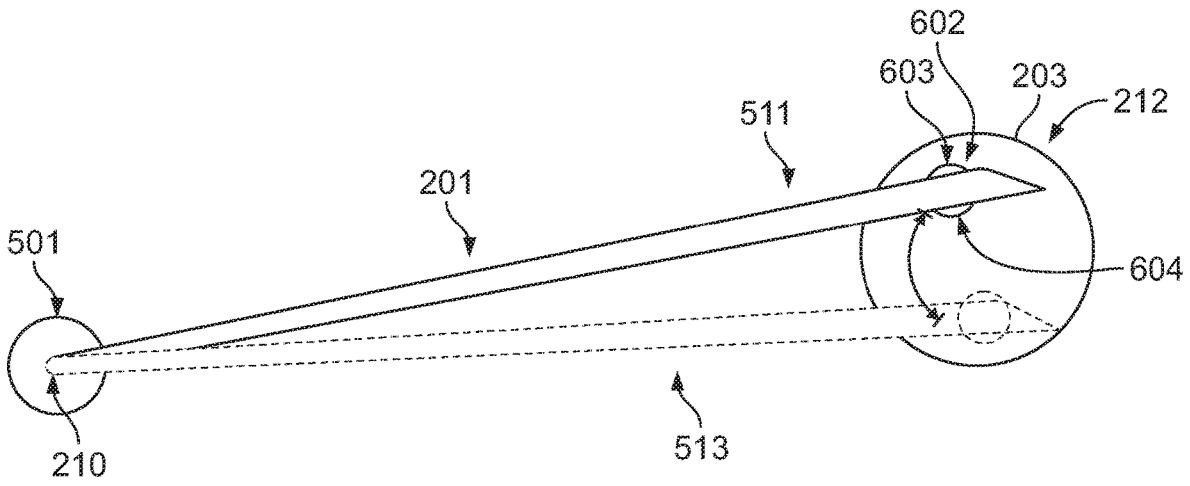
FIG. 6A is a schematic view of a vane assembly of a variable diffuser in accordance with some embodiments of the present disclosure.
Figure 6B:
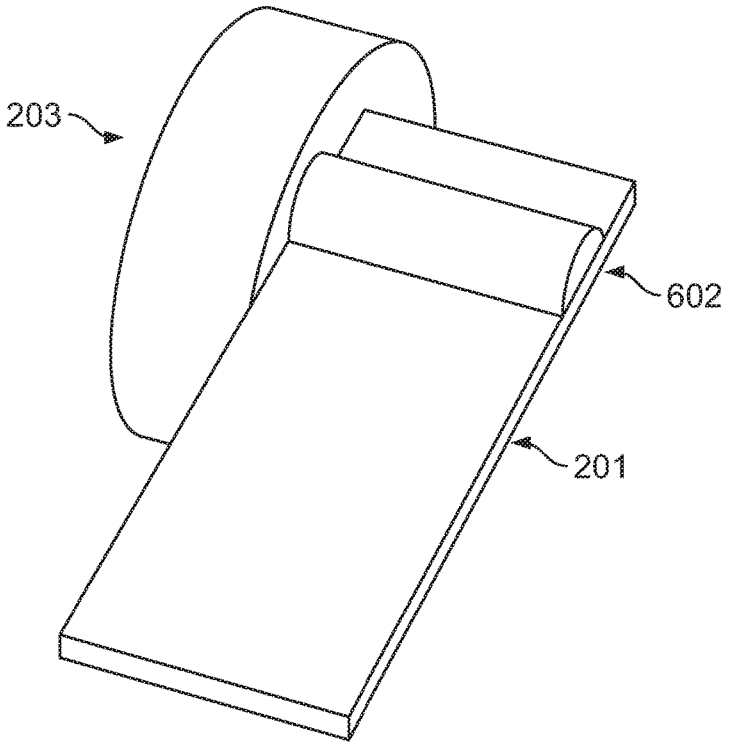
FIG. 6B is a detailed isometric view of a vane assembly of a variable diffuser in accordance with some embodiments of the present disclosure.

In some embodiments, the vane 201 may be coupled to the penny 203 via a forked pin architecture such as that shown in FIGS. 6A and 6B. A forked pin 602 may extend substantially perpendicular from the disk face of the penny 203 and may comprise a first prong 603 spaced from a second prong 604. The gap between the first prong 603 and second prong 604 may be configured to receive a portion of the vane 201 proximate the trailing edge 212. The forked pin 602 may be disposed near an edge of the penny 203. Forked pin 602 may be couple with vane 201 on the trailing edge 212 side of a midpoint between the trailing edge 212 and leading edge 210. Vane 201 may be partially disposed within the fork of the forked pin 602, which is to say between first prong 603 and second prong 604.

At the leading edge 210 the vane 201 may be coupled to hub surface 120 by a vertex penny 501 that rotates along with the rotation of the vane 201. Vertex penny 501 may be a pin extending from the vane 201 into a corresponding recess in the hub surface 120 to allow the vane 201 to pivot.

The rotation of vane 201 is driven by the rotation of penny 203, with rotation of the penny 203 translating into motion of the vane 201 via the forked pin 602. Rotation of penny 203 may cause the forked pin 602 to slide along vane 201 to be closer or further from trailing edge 212, and will cause a pivoting motion of vane 201. The vane 201 may be continuously variable between a first, more open position 511 and a second, more closed position 513 (shown in dashed lines in FIG. 6A).

In some embodiments, the forked pin 602 may be disposed proximate the leading edge 210 and the vertex penny 501 may be coupled to the vane 201 at the trailing edge 212.

There are numerous advantages associated with the slot-and-pin design, including that the vane 201 may be thinner than in the embodiment shown in FIG. 5. Additionally, the forked pin design provides an improved accuracy with which the vane may be positioned and oriented due to the use of a unique penny for each vane. Each vane also has two points of interface with first disk face providing greater structural stability, lowered vane stresses, and greater accuracy in vane alignment.

In still further embodiments, a vane assembly 700 of a variable diffuser may comprise a split vane 702 and penny 203. Split vane 702 has a leading edge 704 and trailing edge 706. A pin proximate the leading edge 704 extends from the split vane 702 and is disposed in a slot 708 of hub surface 120, thus coupling the split vane 702 to the hub surface 120. Slot 708 may be oriented radially, circumferentially, or at an angle with respect to a central axis of hub 121 or an axis of rotation of the centrifugal compressor.

A pivot pin 710 proximate the trailing edge 706 extends from the split vane 702 and is disposed in a corresponding recess of hub surface 120, thus coupling the split vane 702 to the hub surface 120. Alternatively, a pivot pin may extend from hub surface 120 and be disposed in a corresponding aperture of the split vane 702 to couple the split vane 702 to hub surface 120.

Split vane 702 may be coupled to penny 203 proximate a midpoint between the leading edge 704 and trailing edge 706. In some embodiments, a pin 712 may extend substantially perpendicular from penny 203 and be disposed in a corresponding aperture 714 defined by the split vane 702 to thus couple the penny 203 and split vane 702.

Split vane 702 may comprise two segments, a leading edge segment 716 and a trailing edge segment 718. The leading edge segment 716 may extend between the leading edge 704 and a portion of the split vane 702 proximate the penny 203, while the trailing edge segment 718 may extend between the trailing edge 706 and a portion of the split vane 702 proximate the penny 203. Leading edge segment 716 terminates opposite the leading edge 704 in an aft end 730. Trailing edge segment 718 terminates opposite the trailing edge 706 in a forward end 732.

In the illustrated embodiment, the leading edge segment 716 defines aperture 714, and the trailing edge segment 718 comprises the pivot pin 710 or may define the aperture associated with coupling the trailing edge segment 718 to hub surface 120. Leading edge segment 716 may be coupled to penny 203 near the aft end 730. Leading edge segment 716 and trailing edge segment 718 may be coupled by an slidable and overlapping joint 720. Forward end 732 of trailing edge segment 718 may rest on the aft end 730 of leading edge segment 716.

Split vane 702 may be coupled to tip 123. For example, tip 123 may define a slot, and the slot may be opposite slot 708. Split vane 702 may comprise a pin extending from the vane 702 and disposed in the slot of the tip 123 to thereby couple the split vane 702 to tip 123.

In operation, penny 203 is coupled to an actuator such as described below with reference to FIGS. 9 and 10. The actuator rotates penny 203, in some embodiments via a drive shaft, and causes both a translating and pivoting motion of leading edge segment 716. Trailing edge segment 718 sides along and pivots with the leading edge segment 716 at joint 720, creating a pivoting motion of trailing edge segment 718. Thus the rotation of penny 203 causes adjustments to the positioning and orientation of split vane 702.

Figure 7:
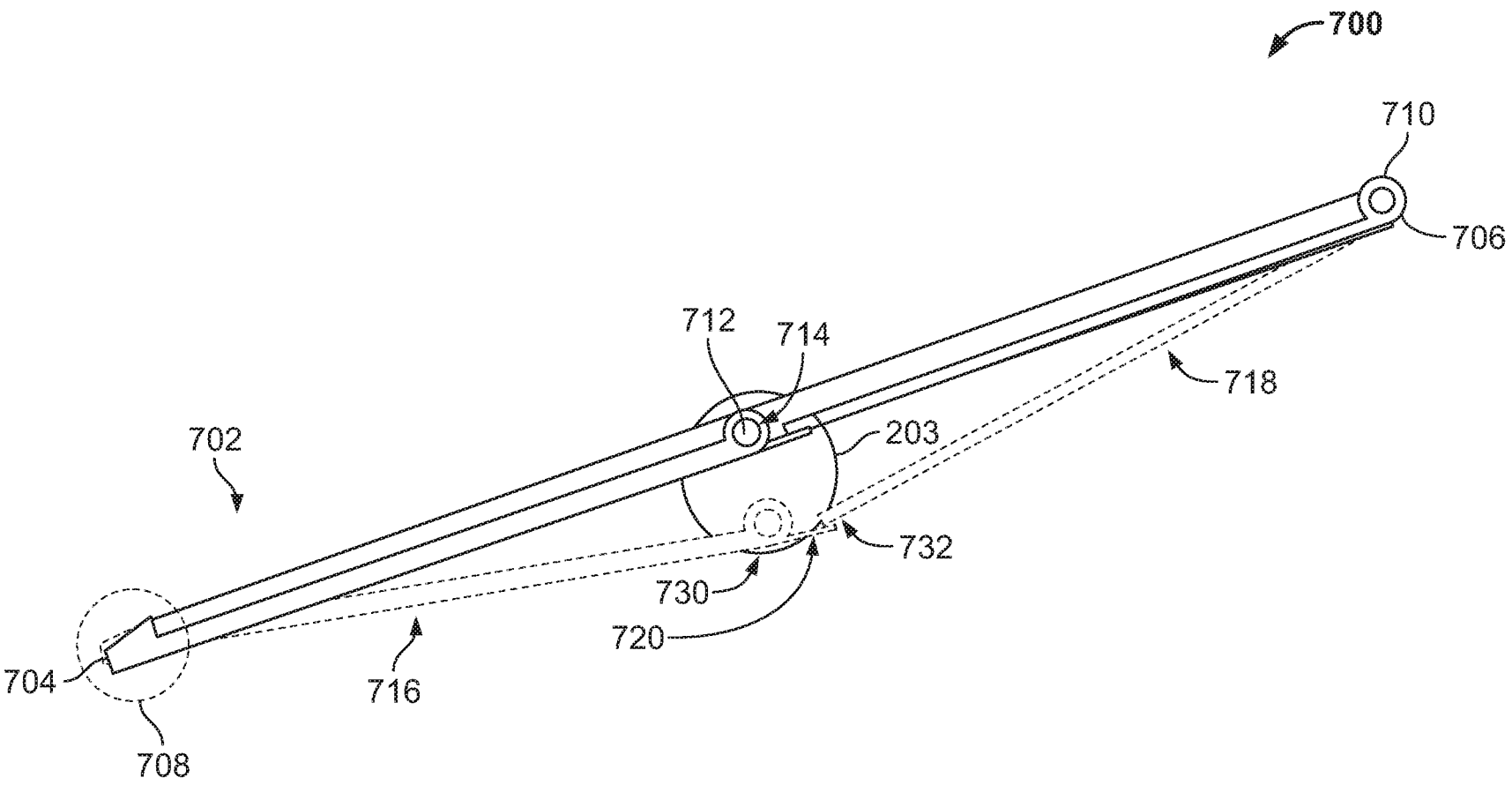
FIG. 7 is a schematic view of a vane assembly of a variable diffuser in accordance with some embodiments of the present disclosure.

The embodiment presented in FIG. 7 is advantageous in that it provides three points of contact between split vane 702 and hub surface 120, allowing for improvements in distributing the load to multiple contact points. The embodiment also provides a shorter overall vane span, and reduces head loss when in the more closed position.

Figure 8:
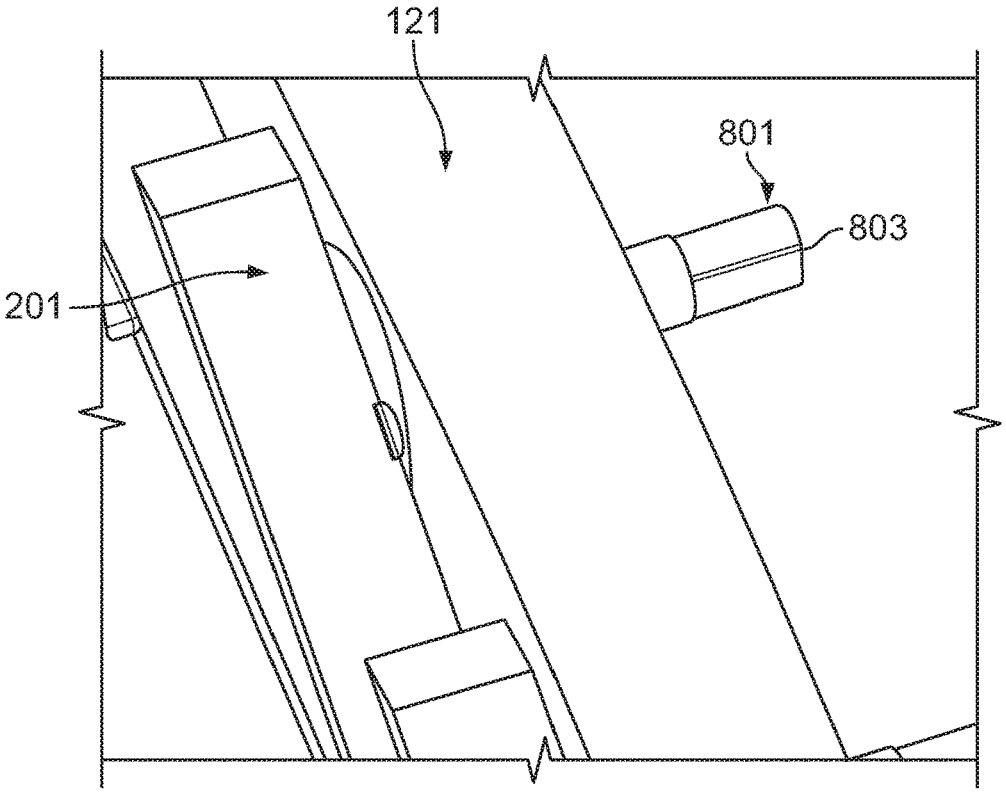
FIG. 8 is a detailed isometric view of a penny having a drive shaft in accordance with some embodiments of the present disclosure.

FIG. 8 provides an isometric view of a vane assembly, showing a drive shaft 801 extending from a penny 203 at a side opposite the side coupled to the vane 201. The penny 203 and/or drive shaft 801 thus extend through the hub 121. A seal or O-ring may be used to seal between the aperture 221 in hub 121 and either one or both of penny 203 and drive shaft 801. The seal or O-ring (not visible in FIG. 8) may be configured to prevent leakage from the hub surface 120 side of hub 121 to the opposite side. Drive shaft 801 may extend substantially perpendicular to penny 203. Drive shaft 801 may be configured at a free end 803 to couple to an actuator; free end 803 may have a non-circular (or non-cylindrical) shape to accommodate coupling of drive shaft 801 to an actuator.

As discussed above, in some embodiments each of the plurality of pennies 203 may be coupled to one or more actuators via a coupling member. In the embodiment of FIG. 9, the actuator is an actuating ring 951 that is coupled to each of the plurality of pennies 203 via a plurality of respective coupling members: arm linkages 953. Each arm linkage 953 is coupled between actuating ring 951 and a respective one of the plurality of pennies 203. Arm linkages 953 may be coupled to the actuating ring 951 by mounting pins or similar fasteners.

Rotation of actuating ring 951 will translate through arm linkages 953 and drive shafts 801 to effect rotation of each of the plurality of pennies 203. In some embodiments, the pennies 203 are rotated in unison by the actuator such as actuating ring 951. As discussed in the various embodiments above, rotation of each of the plurality of pennies 203 results in rotation, pivoting, repositioning, and/or reorienting of a respective vane of the variable diffuser.

Figure 10:
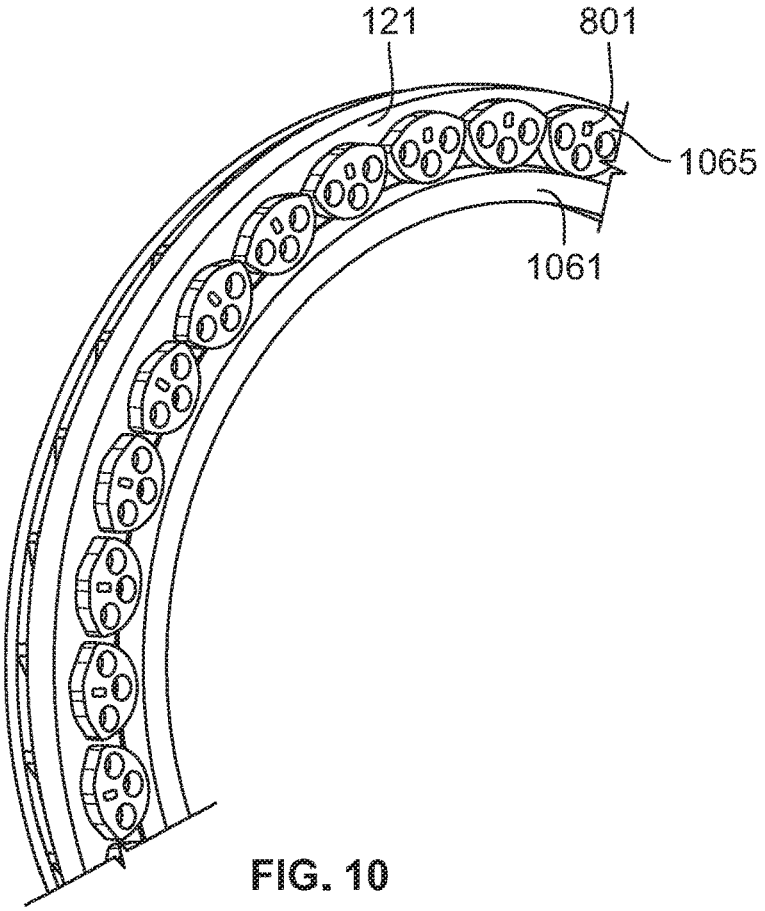
FIG. 10 is an isometric view of an actuating ring having pinion gear linkages to each vane assembly of a variable diffuser in accordance with some embodiments of the present disclosure.

In the embodiment of FIG. 10, the actuator is an actuating ring referred to as gear ring 1061. The gear ring 1061 is coupled to each of the plurality of pennies 203 via a plurality of respective coupling members: pinion gears 1065. Each pinion gear 1065 is coupled between gear ring 1061 and a respective one of the plurality of pennies 203. Pinion gear 1065 may be coupled to the gear ring 1061 by intermeshed teeth or similar gearing features. Although in FIG. 10 the ring gear 1061 is shown radially inward from the plurality of pinion gears 1065, it is also envisioned that the ring gear 1061 may be positioned radially outward or axially adjacent to the pinion gears 1065.

Rotation of gear ring 1061 will translate through pinion gear 1065 and drive shafts 801 to effect rotation of each of the plurality of pennies 203. In some embodiments, the pennies 203 are rotated in unison by the actuator such as gear ring 1061. As discussed in the various embodiments above, rotation of each of the plurality of pennies 203 results in rotation, pivoting, repositioning, and/or reorienting of a respective vane of the variable diffuser.

Figure 11:
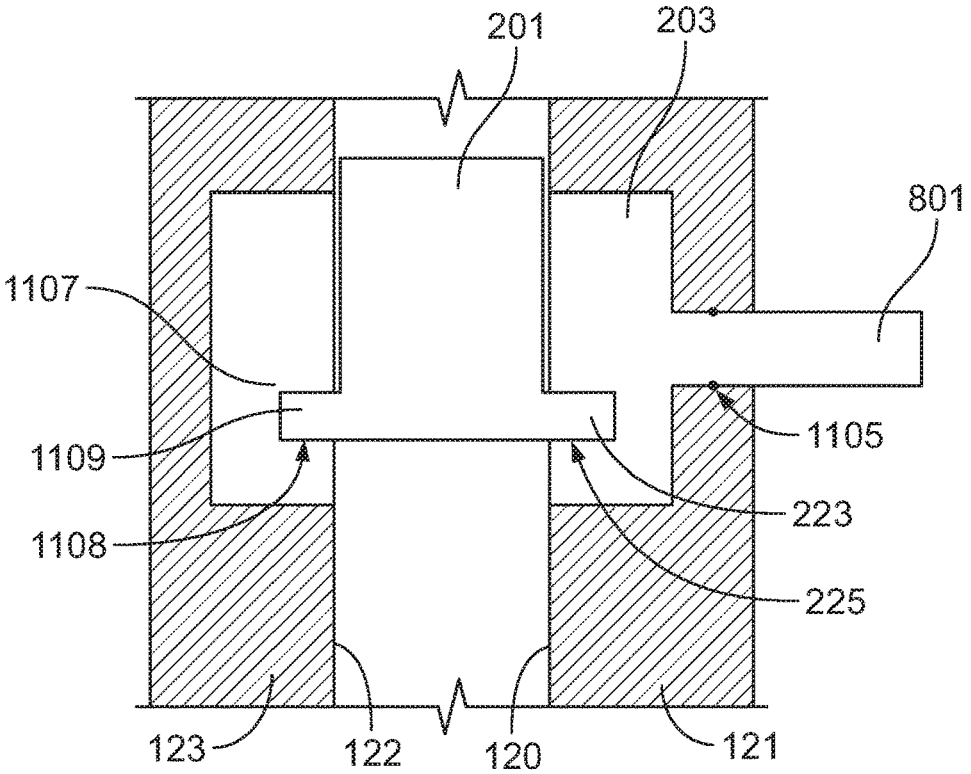
FIG. 11 is a side profile cutaway view of a portion of a variable diffuser in accordance with some embodiments of the present disclosure.

In some embodiments the vanes discussed above are coupled to the hub 121 at two locations and extend outward from the hub surface 120 into passage 116 but do not couple with tip 123. In other embodiments, the vanes discussed above may be coupled to the hub 121 at two locations, extend outward from the hub surface 120 into passage 116, and also be coupled to tip 123. FIG. 11 presents a cutaway view of a vane 201 coupled to both hub 121 and tip 123.

Penny 203 is coupled to vane 201 and housed in hub 121. A pin 223 extends from vane 201 and into a recess 225 defined by the penny 203 to effect coupling between the vane 201 and penny 203.

A drive shaft 801 extends from the penny 203 and through hub 121, protruding from hub 121 in order to be coupled to an actuator. A seal 1105 may be provided between the drive shaft 801 and hub 121 in order to prevent leakage through hub 121. The seal 1105 may also be placed between the penny 203 and hub 121.

Vane 201 may be coupled to a dummy penny 1107 housed in tip 123. Dummy penny 1107 may define a recess 1108, and a pin 1109 may extend from vane 201 into the recess 1108 to couple the vane 201 to the dummy penny 1107. Dummy penny 1107 may be configured to rotate freely, such that motion of vane 201 is entirely driven by an actuator via drive shaft 801 and penny 203. In some embodiments, dummy penny 1107 may also be coupled to an actuator that is either the same or different from the actuator coupled to drive shaft 801.

Figure 13:
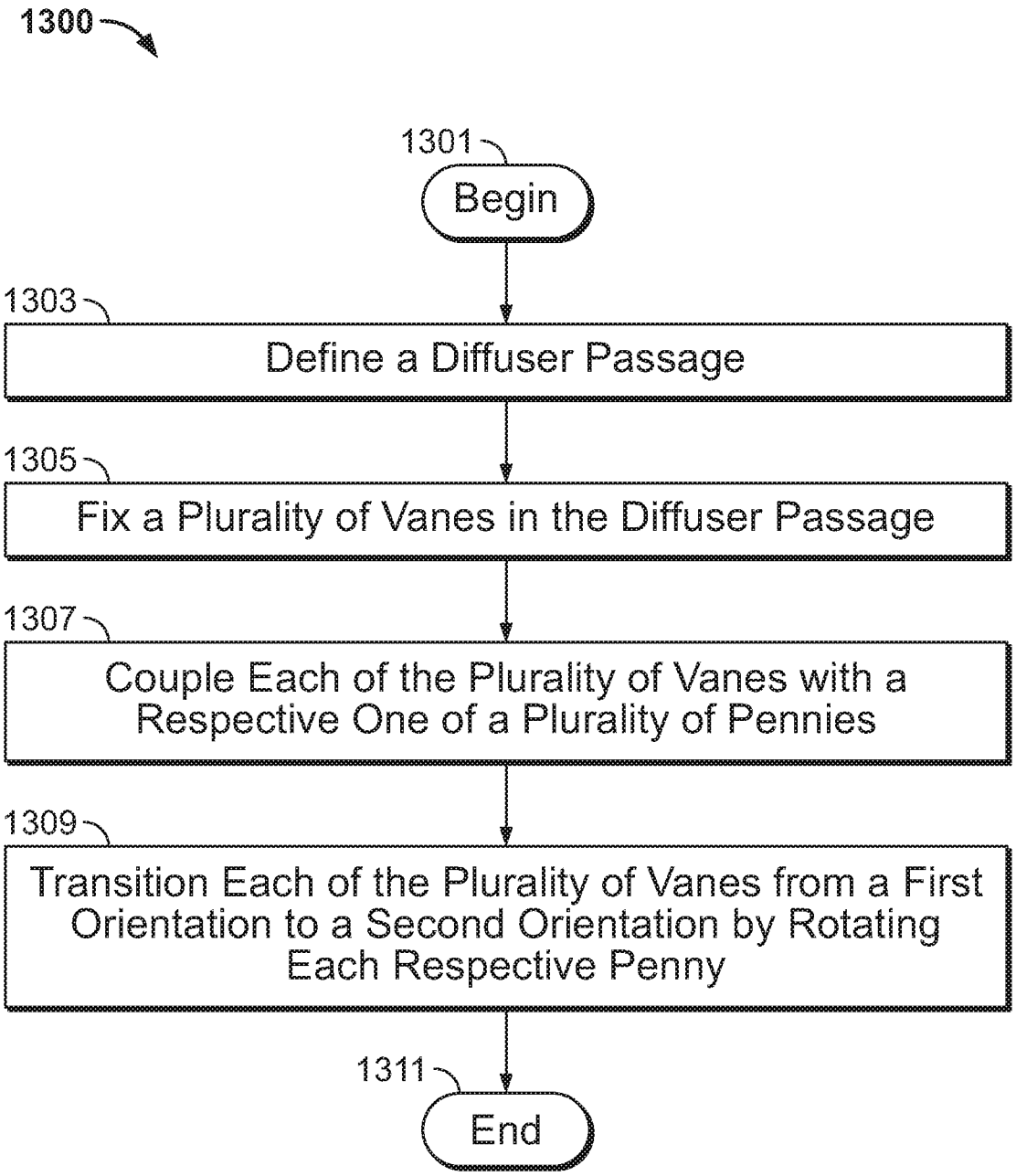
FIG. 13 is a flow diagram of a method in accordance with some embodiments of the present disclosure.
Figure 14:
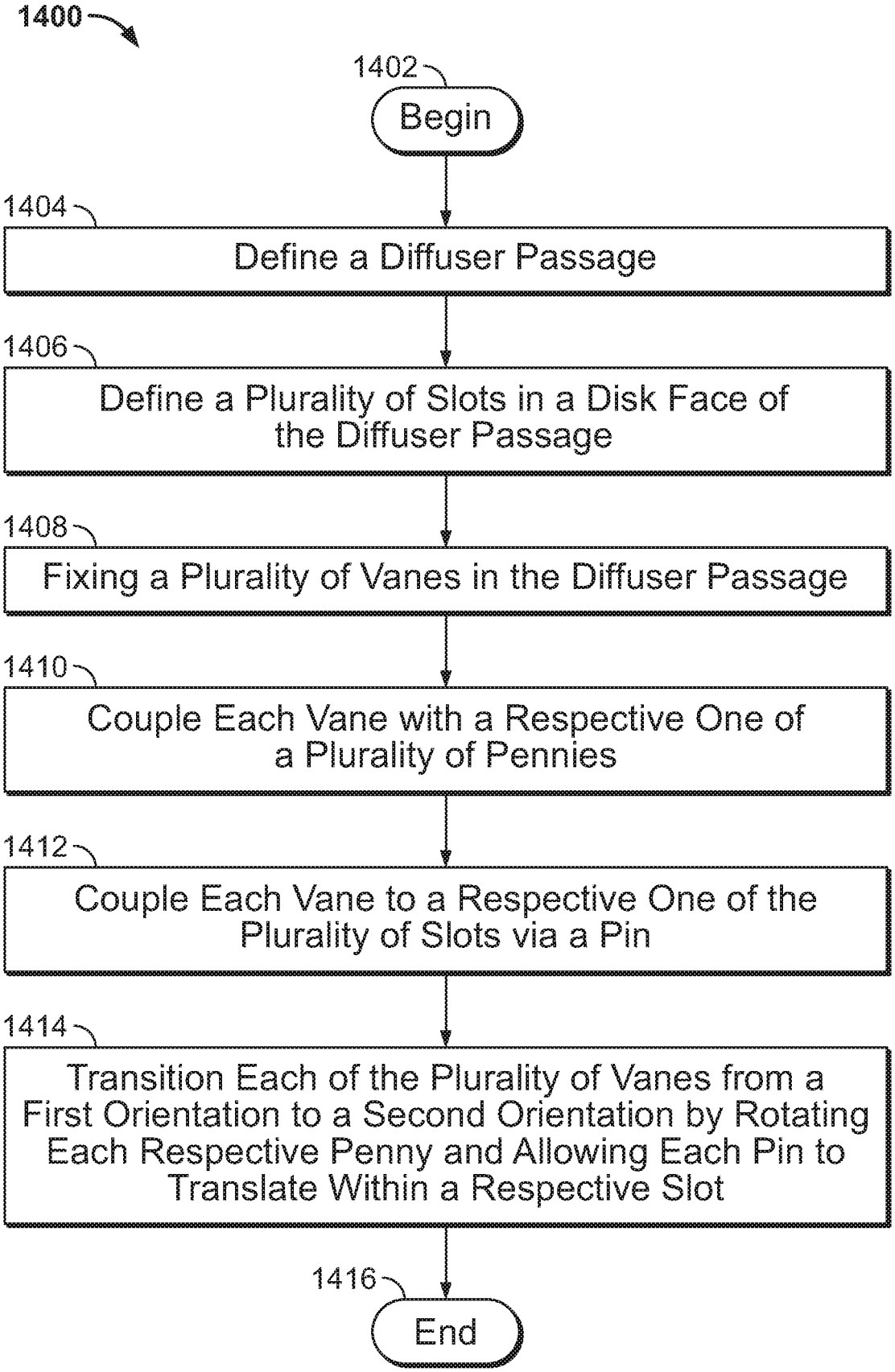
FIG. 14 is a flow diagram of a method in accordance with some embodiments of the present disclosure.

In addition to the systems, apparatuses, and structures described above, the present disclosure presents methods for varying fluid flow in a centrifugal compressor. These methods may be used to improve stall margin during low flow conditions. FIGS. 13 and 14 provide a flow chart for methods 1300 and 1400, respectively.

Method 1300 begins at Block 1301 and proceeds to Block 1303 where a diffuser passage is defined. The diffuser passage may be defined between a hub surface 120 and tip surface 122. The diffuser passage may be defined between the opposing faces 120, 122 of a hub 121 and tip 123.

At Block 1305, a plurality of vanes are fixed in the diffuser passage. The vanes may be of the type of variable vane 201 or split vane 702 described above. The vanes may each extend between hub 121 and tip 123.

Each of the plurality of vanes are coupled to a respective one of a plurality of pennies 203 at Block 1307. The pennies 203 may be housed in hub 121 or tip 123. Vanes and pennies 203 may be coupled via a vane pin and penny recess, a slotted vane and penny pin, vane aperture and penny pin, and a forked penny pin architecture such as those described above. The pennies 203 may each be rotatable through at least 90°. Block 1307 and 1405 may be performed in any order; in other words, the vanes may be fixed in the diffuser passage and then coupled to pennies 203, or the vanes may be coupled to pennies 203 and then fixed in the diffuser passage. The plurality of pennies 203 may be coupled to one or more actuators.

At Block 1309 the pennies are rotated to transition each vane from a first orientation to a second orientation. The first orientation may be more open or more closed than the first orientation. The vanes may be continuously variable between a most open orientation and a most closed orientation. The pennies may be rotated in unison or individually. The pennies may be rotated by the actuation of an actuator coupled to the pennies.

Method 1300 ends at Block 1311.

Method 1400 begins at Block 1402 and proceeds to Block 1404 where a diffuser passage is defined. The diffuser passage may be defined between a hub surface 120 and tip surface 122. The diffuser passage may be defined between the opposing faces 120, 122 of a hub 121 and tip 123.

A plurality of slots, such as slot 207, may be defined in one or both of hub surface 120 and tip surface 122 at Block 1406. The slots may be oriented radially, circumferentially, or at an angle with respect to a central axis of either hub 121 or tip 123, or with respect to an axis of rotation of the centrifugal compressor.

At Block 1408, a plurality of vanes are fixed in the diffuser passage. The vanes may be of the type of variable vane 201 or split vane 702 described above. The vanes may each extend between hub 121 and tip 123.

Each of the plurality of vanes are coupled to a respective one of a plurality of pennies 203 at Block 1410. The pennies 203 may be housed in hub 121 or tip 123. Vanes and pennies 203 may be coupled via a vane pin and penny recess, a slotted vane and penny pin, vane aperture and penny pin, and a forked penny pin architecture such as those described above. The pennies 203 may each be rotatable through at least 90°. Blocks 1408 and 1410 may be performed in any order; in other words, the vanes may be fixed in the diffuser passage and then coupled to pennies 203, or the vanes may be coupled to pennies 203 and then fixed in the diffuser passage. The plurality of pennies 203 may be coupled to one or more actuators.

At Block 1412 each vane is coupled to a respective one of the plurality of slots via a pin. The pin is configured to translate or move within the slot.

At Block 1414 the pennies are rotated to transition each vane from a first orientation to a second orientation. Each pin is allowed to translate within a respective slot. The first orientation may be more open or more closed than the first orientation. The vanes may be continuously variable between a most open orientation and a most closed orientation. The pennies may be rotated in unison or individually. The pennies may be rotated by the actuation of an actuator coupled to the pennies.

Method 1400 ends at Block 1416.

Figure 12A:
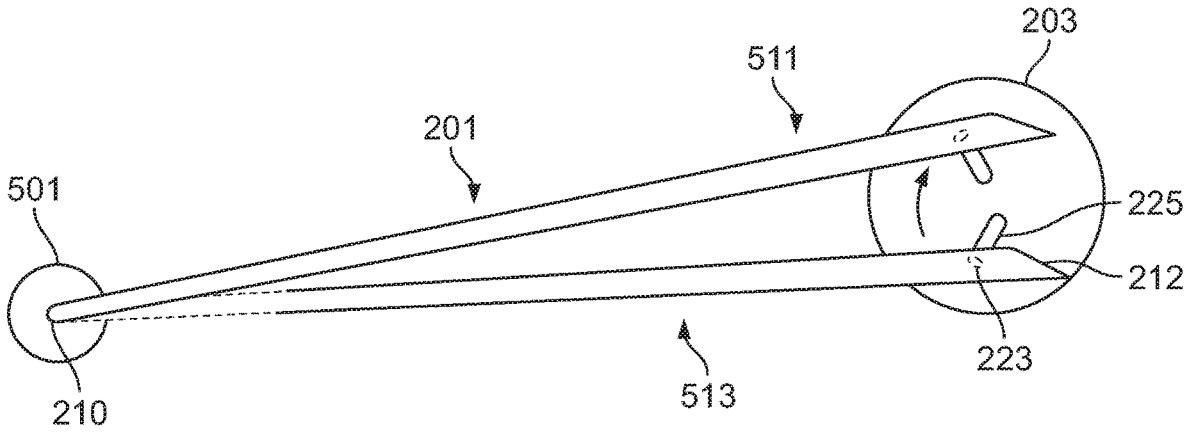
FIGS. 12A, 12B, and 12C are schematic and detailed views of a vane assembly of a variable diffuser in accordance with some embodiments of the present disclosure.
Figure 12B:
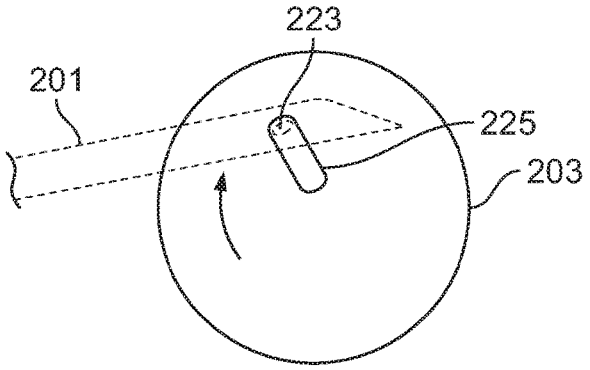
Figure 12C:
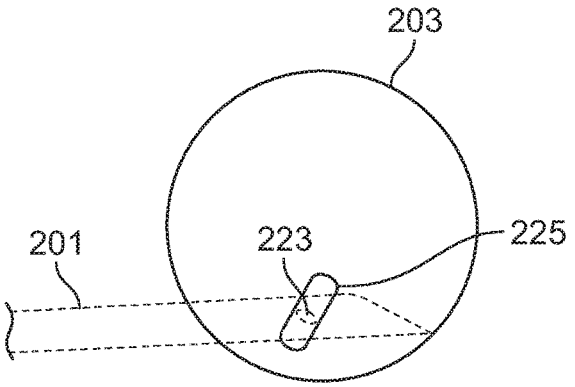

FIGS. 12A-12C illustrate an embodiment of the variable diffuser in which the recess 225 comprises an elongated slot in the drive penny 203 that receives a pin 223 rigidly attached to the vane 201. As the penny 203 rotates, the pin 223 slides within the elongated-slot recess 225 to account for the relative translation of the pin 223 during the transition between the more open position 511 shown in FIG. 12B and the more closed position 513 shown in FIG. 12C. The leading edge 210 of the vane 201 is translationally fixed via a vertex penny 501. The location of penny 203 and elongated-slot recess 225 proximate the trailing edge 212 of the vane 201 reduces interruptions and losses in comparison to slots located closer to the leading edge 210.

Although examples are illustrated and described herein, embodiments are nevertheless not limited to the details shown, since various modifications and structural changes may be made therein by those of ordinary skill within the scope and range of equivalents of the claims.

What is claimed is:

1. A variable diffuser comprising:

a passage defined between opposing faces of a hub and a tip;

at least one vane within the passage, said vane comprising a body having a leading edge and a trailing edge, the body extending between the hub face and the tip face; and at least one rotatable penny coupled to said body and an actuator, wherein the penny is coupled to the body near an edge of the penny;

wherein the hub face defines a slot and the body is coupled to the hub face via a pin extending from the body and into the slot, the pin movable within the slot;

wherein rotation of at least one penny changes an orientation of the at least one vane relative to the hub face.

2. The variable diffuser of claim 1, wherein the slot can be oriented radially with respect to a center axis.

3. The variable diffuser of claim 1, wherein the slot can be oriented circumferentially with respect to a center axis.

4. The variable diffuser of claim 1, wherein the tip face defines a second slot opposite the slot in the hub face, and the body is coupled to the tip face via a second pin extending from the body to the second slot.

5. The variable diffuser of claim 1, wherein the penny is configured to rotate in unison with other pennies.

6. The variable diffuser of claim 5, wherein the first position results in a passage that is more open than the second position.

7. The variable diffuser of claim 5, wherein said actuator comprises an actuating ring, the penny having a drive shaft extending from a first face of the penny, said first face opposite a second face of the penny proximate the respective vane body, and wherein said actuating ring is coupled to each penny drive shaft via a respective coupling member.

8. The variable diffuser of claim 7, wherein the coupling member is a pinion gear.

9. The variable diffuser of claim 7, wherein the coupling member is an arm linkage.

10. The variable diffuser of claim 1, wherein the orientation of the vane is continuously variable between a first position and a second position.

11. The variable diffuser of claim 1, wherein the penny is housed in the hub face.

12. The variable diffuser of claim 11, wherein the vane body is coupled to the tip face via a freewheeling penny.

13. A variable diffuser comprising:

a passage defined between opposing faces of a hub and a tip;

a vane within the passage, said vane comprising a leading edge segment and a trailing edge segment, each segment extending between the hub face and the tip face;

a rotatable penny coupled to the leading edge segment and an actuator, wherein the penny is coupled to the leading edge segment near an edge of the penny; and wherein the hub face defines a slot and the leading edge segment is coupled to the hub face via a pin extending from the leading edge segment into the slot, the pin movable within the slot;

wherein the trailing edge segment is coupled to the hub face via a pin extending from the trailing edge segment to the hub face; and wherein rotation of the penny changes an orientation of the leading edge segment relative to the hub face, and changes in the orientation of the leading edge segment causes changes an orientation of the trailing edge segment relative to the hub face.

14. The variable diffuser of claim 13, wherein the leading edge segment is coupled to the penny near an aft end.

15. The variable diffuser of claim 13, wherein a forward end of the trailing edge segment rests on an aft end of the leading edge segment.

16. The variable diffuser of claim 13, wherein the slot can be oriented radially with respect to a center axis.

17. The variable diffuser of claim 13, wherein the slot can be oriented circumferentially with respect to a center axis.

18. The variable diffuser of claim 13, wherein the tip defines a second slot opposite the slot in the hub, and the body is coupled to the tip via a second pin extending from the body to the second slot.

19. A method of varying fluid flow exiting a centrifugal compressor, the method comprising:

defining a diffuser passage between a pair of axially displaced and opposing disk faces;

defining a plurality of slots within the first disk face;

fixing a plurality of vanes in the diffuser passage, each vane extending between the opposing disk faces, coupled to a respective penny housed in a first of the disk faces and coupled to a respective pin extending from the vane into the respective slot; and transitioning each of the plurality of vanes from a first orientation relative to the diffuser passage to a second orientation relative to the diffuser passage by rotating each respective penny in unison and allowing each respective pin to translate within each respective slot.

20. The method of claim 19 wherein each respective penny is coupled to an actuator and wherein the step of transitioning each of the plurality of vanes from a first orientation relative to the diffuser passage to a second orientation relative to the diffuser passage by rotating each respective penny in unison is performed by actuating the actuator.

* * * * *